US010759511B2

(12) United States Patent
Mudupu et al.

(10) Patent No.: US 10,759,511 B2
(45) Date of Patent: Sep. 1, 2020

(54) FLOATING VESSEL WITH GEARLESS POD PROPULSOR HAVING COUNTER ROTATING PROPELLERS

(71) Applicant: THRUSTMASTER OF TEXAS, INC., Houston, TX (US)

(72) Inventors: Venkat Reddy Mudupu, Houston, TX (US); Joannes Raymond Bekker, Houston, TX (US)

(73) Assignee: THRUSTMASTER OF TEXAS, INC., Houston, TX (US)

( * ) Notice: Subject to any disclaimer, the term of this patent is extended or adjusted under 35 U.S.C. 154(b) by 0 days.

(21) Appl. No.: 16/452,350

(22) Filed: Jun. 25, 2019

(65) Prior Publication Data

US 2019/0389553 A1 Dec. 26, 2019

Related U.S. Application Data

(60) Provisional application No. 62/690,030, filed on Jun. 26, 2018.

(51) Int. Cl.

| | |
|---|---|
| ***B63H 23/22*** | (2006.01) |
| ***B63H 5/125*** | (2006.01) |
| ***B63H 21/38*** | (2006.01) |
| ***B63H 23/34*** | (2006.01) |

(52) U.S. Cl.
CPC ..... *B63H 23/22* (2013.01); *B63H 5/125* (2013.01); *B63H 21/38* (2013.01); *B63H 23/34* (2013.01); *B63H 2005/1254* (2013.01)

(58) Field of Classification Search
CPC ..... B63H 23/22; B63H 5/125; B63H 21/38; B63H 23/34
See application file for complete search history.

(56) References Cited

U.S. PATENT DOCUMENTS 7,018,249 B2 * 3/2006 Ries ..... B63H 5/125 440/6
2019/0389553 A1 * 12/2019 Mudupu ..... B63H 21/38

* cited by examiner

*Primary Examiner* — Lars A Olson
*Assistant Examiner* — Jovon E Hayes
(74) *Attorney, Agent, or Firm* — Nolte Intellectual Property Law Group

(57) ABSTRACT

A floating vessel with gearless pod propulsor and counter rotating propellers is secured to a hull, each pod having a lead propeller and a trailing propeller, each propeller connected to a shaft connected to either a stator and rotor or a hydraulic motor. A lead propeller turns in a first direction and a trailing propeller turns in an opposite direction simultaneously, generating thrust for the floating vessel along a thrust vector using the counter rotation of the trailing propeller to recover swirling energy from the lead propeller improving propulsive efficiency of the floating vessel. The pod is positioned below a water line of the floating vessel providing propulsion for the floating vessel without gears.

21 Claims, 5 Drawing Sheets

FLOATING VESSEL WITH GEARLESS POD PROPULSOR HAVING COUNTER ROTATING PROPELLERS

CROSS-REFERENCE TO RELATED APPLICATIONS

This application claims the benefit of U.S. Provisional Application No. 62/690,030, filed Jun. 26, 2018, the contents of which are incorporated herein by reference in its entirety to the extend consistent with the present application.

FIELD

The present embodiments generally relate to a floating vessel with one or more gearless pod propulsors each having counter rotating propellers.

BACKGROUND

A need exists for a floating vessel with a gearless pod propulsor having a trailing propeller that captures energy from a lead propeller to improve propulsive efficiency of the floating vessel.

The present embodiments meet this need.

BRIEF DESCRIPTION OF THE DRAWINGS

The detailed description will be better understood in conjunction with the accompanying drawings as follows.

Figure 1:
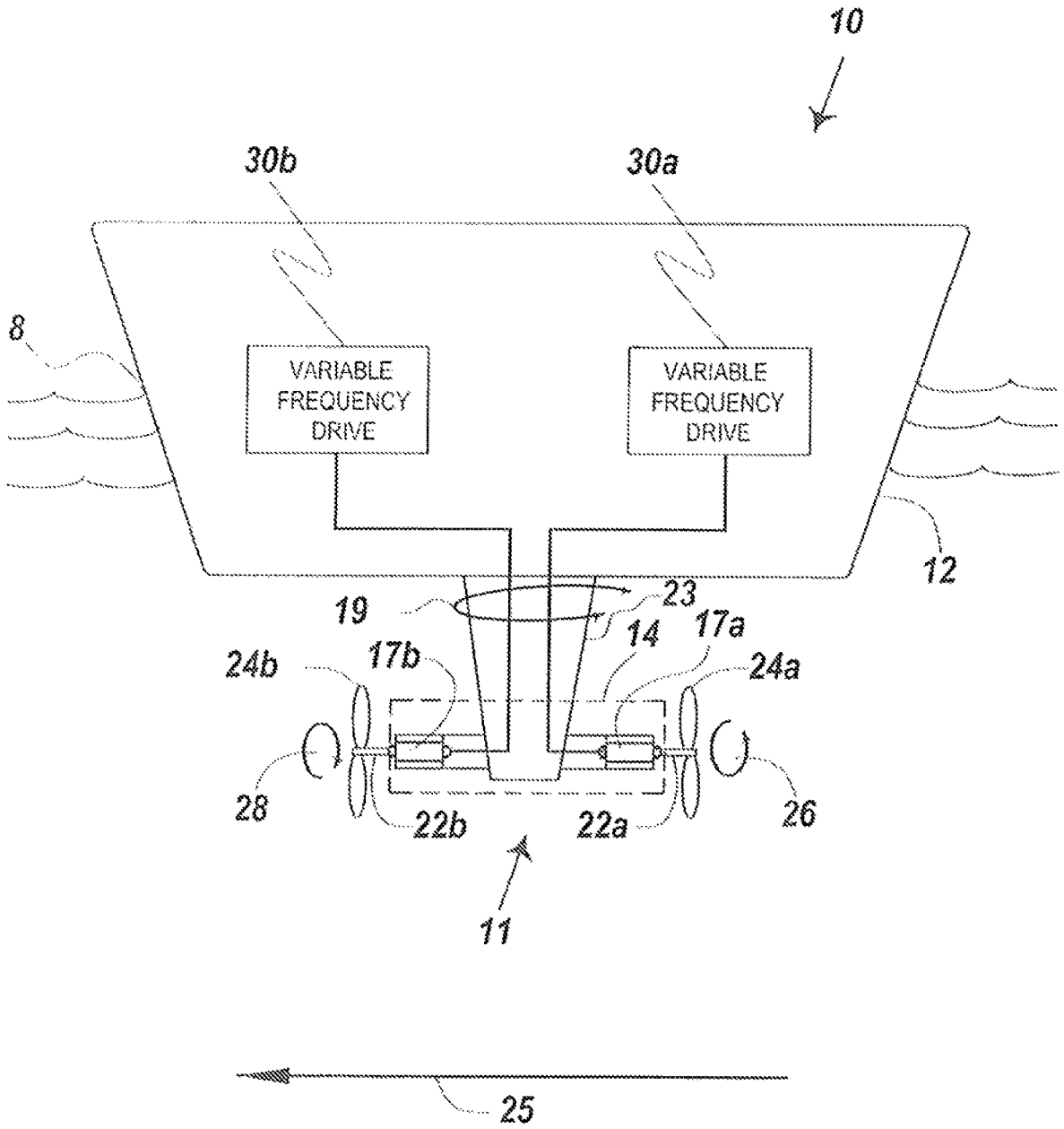
FIG. 1 depicts a first embodiment of a floating vessel according to the invention.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The invention relates to a floating vessel with a gearless pod propulsor and counter rotating propellers secured to a hull.

Each pod of the pod propulsor engages a lead propeller and a trailing propeller.

Each propeller is directly connected to a shaft connected to either a stator and rotor or a hydraulic motor without using gears.

For each pod propulsor, the lead propeller turns in a first direction and the trailing propeller turns in an opposite direction simultaneously generating thrust for the floating vessel along a thrust vector using the counter rotation of the trailing propeller to recover swirling energy from the lead propeller improving propulsive efficiency of the floating vessel, and wherein the pod is positioned below the water line of the floating vessel providing propulsion for the floating vessel without gears.

The invention reduces energy costs of a floating vessel by improving the propulsive efficiency of the propulsion system by not using gears with associated gear losses and by recapturing swirling energy from a lead propeller by a trailing propeller.

The invention prevents casualties on board a vessel by providing improved maneuverability and stability during operation by enabling the hull to be turned efficiently into the wind and waves preventing harm on board.

The invention reduces harm to the environment by reducing emissions from burning less fossil fuels due to the improved efficiency of the propulsion system.

The invention provides improved maneuverability to come to the rescue of overboard sailors thus preventing harm to the sailors.

The term "electric rotor" refers to a rotating part of an electric motor capable of providing rotating torque to a shaft from 0.1 ft/lbs to 1,000,000 ft/lbs.

The term "hydraulic power unit" refers to an assembled arrangement of interconnected hydraulic components generating and controlling hydraulic energy. In one embodiment it comprises one or more diesel engine or electric motor driven hydraulic pumps, one or more hydraulic reservoirs, heat exchangers and particulate filters.

The term "hydraulic fluid" refers to a fluid such as mineral oil, or an environmentally friendly oil that passes the EPA "shrimp test" to prevent the destruction of shrimp living within 0.2 miles of an offshore oil rigs.

The term "hydraulic pump" refers to a device pressurizing hydraulic fluid from 0.1 psi to 5000 psi and can be a hydrostatic transmission pump.

The term "hydraulic reservoir" refers to a reservoir within the hydraulic power unit, and has a volume from 1 to 500 gallons.

The term "lead propeller" refers to a bronze or stainless steel propeller secured to a shaft having from 3 to 6 blades with each blade having a pitch in a range from 1 to 120 inches.

The term "nozzle" refers to a covering around the trailing propeller which enhances velocity of fluid through the blades of the propeller. The nozzle can be made from steel or stainless steel. The nozzle can be tapered. The nozzle is used to improve the efficiency of a propeller. Nozzles are often referred to as a "shroud" wherein the cross section has the form of a foil providing lift and thrust.

The term "partially projecting from a pod" when used with the shafts of the propellers refers to a shaft projecting from 5% to 99% of the total length of the propeller shaft from the pod.

The term "particulate straining filter" refers to a device for removing particulate having a diameter from 5 to 500 microns from hydraulic fluid in the hydraulic power unit. In embodiments, the particulate can be sand, rock, foam or metal flakes. In embodiments, the particulate straining filter can be a synthetic filter or a cellulose filter. In embodiments, the particulate straining filter is sized to be compatible with the hydraulic flow rate of the hydraulic pumps.

The term "permanent magnet motor" refers to an electric motor whereby the rotor is provided with permanent magnets on the periphery of the rotor. The permanent magnets are made from rare earth material. The power range of permanent magnet motors can be in the same range as induction motors. Permanent magnet motors have higher power density than induction motors. Uniquely, permanent magnet motors weigh less and have smaller dimensions than induction motors, which is a feature of the invention.

The term "pod" refers to a housing that attaches to a hull which can rotate or be stationary. Pods are typically watertight. The size of the pod depends on power ratings of the propulsor. Pods can be cigar shape, which has low drag through the water thereby lowering resistance of the propulsor at different vessel speeds. In embodiments, a pod can be a steel shell that is 6 feet long, 1 foot in diameter and suspended from the keel, from 3 to 8 feet. Larger pods, for instance 16 feet long, can be used. The housing forming the pod can use plate steel having a thickness from ¼ inch to 3 inches. In an example, cathodic protection is installed in all pods.

The term "pod propulsor" refers to the assembly with a pod which functions as a housing, positioned below the keel, or on a side of the hull, such as a starboard side or port side. The pod can be constructed from an aluminum or steel housing, containing propeller shafts and further containing in one embodiment, hydraulic motors, or in a different embodiment, electric motors, with each motor having a stator and a rotor. Each motor is connected to a shaft or a hollow rotor with the propeller shaft inserted into the hollow rotor.

The term "propulsive efficiency of the floating vessel" refers to effective thrust produced by the propulsion machinery as a function of the amount of power required to produce that thrust. Propulsive efficiency is expressed in percent of the beneficially used power divided by input power of the vessel.

The term "shallow water operation" of the floating vessel refers to marine operations in depths less than 3 times the draft of the vessel.

The term "stator" refers to a fixed part of an electric motor with electromagnets created by windings around steel.

The term "steerable strut" refers to generally a component of the pod housing that extends between the pod and the hull. In an embodiment it can be a tapered strut, from the hull to the pod (smaller diameter at the pod). It can be a separate piece bolted to the pod housing rather than being an integral component of the pod housing. The steerable strut can be hollow and can contain electrical conductors for the electric motor embodiments and, for the hydraulic embodiments, contains hydraulic conductors that connect from the hydraulic power units to the hydraulic motors in the pod.

The term "recover swirling energy" refers to the act of recovering energy based on rotating water from a first rotating propeller. The first rotating propeller attached to the pod generates usually unwanted swirling water while generating the desired water flowing in an axial direction. The swirling spiraling water from the first rotating propeller usually does not contribute to the propulsion thrust of the vessel. The invention adds a second rotating propeller acting in a counter rotating direction to the first rotating propeller to specifically recover and apply to the vessel the energy of the swirling water produced by the first rotating propeller. The second propeller behind the first propeller creates a two propeller combination more fuel efficient than a single propeller, adding energy to vessel movement without increasing energy consumption by the motors.

The term "thrust vector" refers to a direction and magnitude of the thrust produced by the pod propulsor. The thrust vector is in the direction indicated from the first propeller to the second propeller on the pod.

The term "trailing propeller" refers to the propeller rotating in a direction opposite from the leading propeller and positioned on an opposite end of the pod from the leading propeller.

The term "variable frequency drive" refers to an electronic assembly that can be adjusted to change frequency of electric power being transmitted to permanent magnet motors, thereby controlling the revolutions per minute (rpm) of the motors, such as from 0.001 rpm to 5000 rpm.

The term "without gears" refers to an assembly that has no mechanical devices with teeth and interlocking assembly that rotate and can reverse the direction of rotation and/or change the revolutions per minute (rpm) and the torque from the input shaft to the output shaft.

Turning now to the Figures, FIG. 1 depicts a first embodiment of a floating vessel.

FIG. 1 shows a floating vessel 10 with pod propulsor 11 and counter rotating propellers 24*a* and 24*b*.

The floating vessel 10 has a hull 12. The hull can be a mono-hull, a hull with a moon pool, a catamaran, a trimaran or another floating hull.

The pod propulsor 11 is depicted connected external to the hull 12.

The pod propulsor has a pod 14.

The pod 14 of the pod propulsor 11 contains a pair of a combination of stators and electric rotors shown as permanent magnet motors 17*a* and 17*b*.

Each permanent magnet motor engages a respective shaft 22*a* and 22*b*. Each shaft is connected to one of the electric rotors, each shaft projects from an opposite end of the pod propulsor 11.

FIG. 1 shows a lead propeller 24*a* and a trailing propeller 24*b*.

Each propeller is connected to one of the shafts 22*a* and 22*b*.

The lead propeller 24*a* turns in a first direction 26 and the trailing propeller 24*b* turns in an opposite direction 28 from the lead propeller 24*a*, simultaneously.

A first variable frequency drive 30*a* is depicted mounted in the hull 12 and electrically connected to the first permanent magnet motor 17*a*.

A second variable frequency drive 30*b* is depicted mounted in the hull 12 and electrically connected to the second permanent magnet motor 17*b*.

Each variable frequency drive controls propeller speed independently.

The pod propulsor with propellers generates thrust for the floating vessel 10 along a thrust vector 25 using the counter rotation of the trailing propeller to recover swirling energy from the lead propeller improving propulsive efficiency of the floating vessel.

The pod 14 is positioned below a water line 8 of the floating vessel providing propulsion for the floating vessel without gears.

Floating vessel 10 has a steering unit with steerable strut 23 extending at least partially through a bottom passage of the floating vessel to the pod 14. In embodiments, the pod with steerable strut is azimuthing.

FIG. 1 shows steering motion 19 of the steering unit with steerable strut 23.

Figure 2:
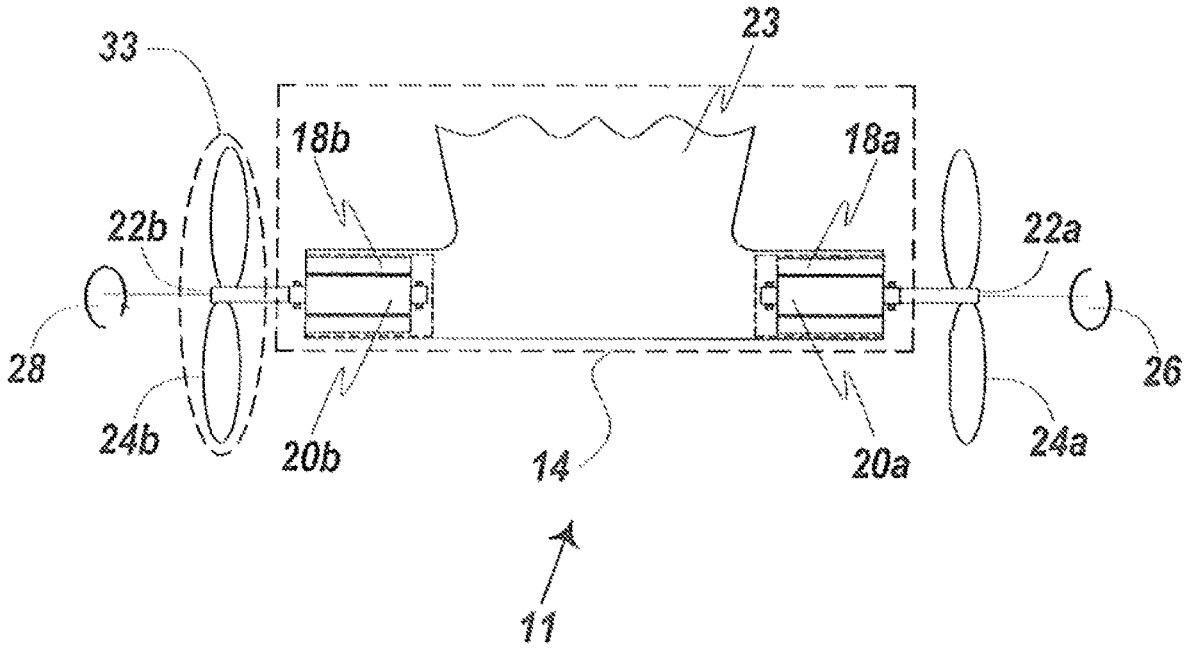
FIG. 2 depicts a detailed view of a pod propulsor shown in FIG. 1.

FIG. 2 depicts a detailed view of the pod propulsor 11.

The pod propulsor is shown with the pod 14.

FIG. 2 shows the steering unit with steerable strut 23 extending into the pod 14.

FIG. 2 depicts a pair of stators 18*a* and 18*b* mounted in the pod 14 and a pair of electric rotors 20*a* and 20*b* mounted in the pod 14. Each electric rotor is turning inside one of the stators.

FIG. 2 shows the pair of shafts 22*a* and 22*b* with each shaft connected to one of the electric rotors projecting at least partially from opposite ends of the pod 14.

FIG. 2 also depicts a nozzle 33 disposed around the trailing propeller 24*b*. The nozzle 33 further improves slow speed propulsive efficiency and provides better convergence and direction of the fluid flow.

The nozzle 33 can be made from steel and can be powder coated in embodiments.

The leading propeller, labeled 24*a* in the illustrated embodiments, can have a nozzle as well surrounding the propeller.

FIG. 2 shows the leading propeller 24*a* and the trailing propeller 24*b* each connected to one of the shafts. The leading propeller 24*a* turns in a first direction 26 and the trailing propeller 24*b* turns in an opposite direction 28 from the leading propeller, simultaneously.

In embodiments, each electric rotor and stator combination is a permanent magnet motor.

The permanent magnet motor can use rare earth magnets.

Figure 3:
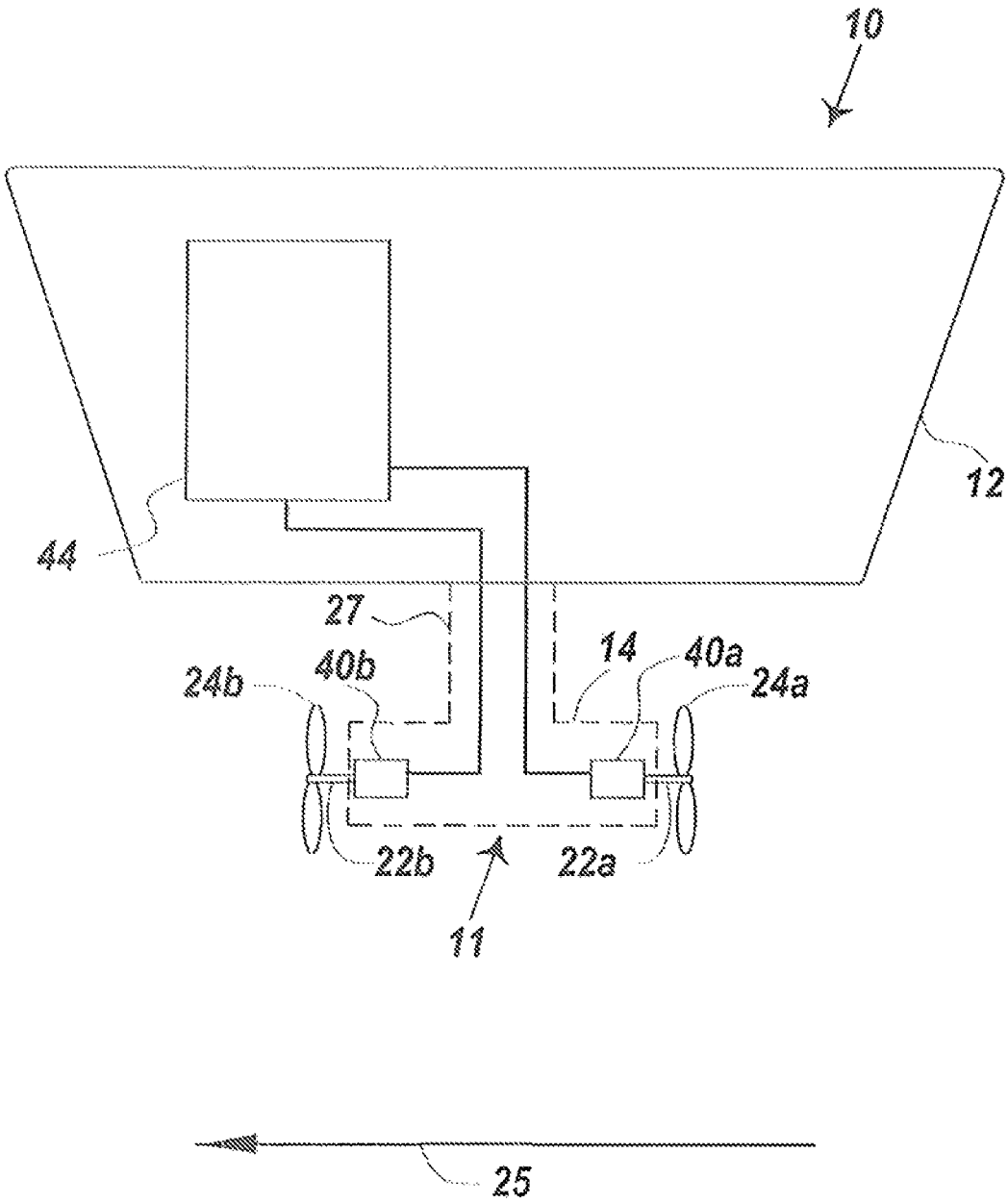
FIG. 3 depicts a second embodiment of a floating vessel according to the invention.

FIG. 3 depicts another embodiment of the floating vessel 10.

The floating vessel 10 with pod propulsor with counter rotating propellers is depicted with a hull 12 and a pod propulsor 11 connected external to the hull.

The pod propulsor is shown with a pod 14; a first and a second hydraulic motor 40*a* and 40*b* mounted in the pod 14; a first and a second shaft 22*a* and 22*b*, each shaft connected to one of the hydraulic motors with each shaft projecting at least partially from opposite ends of the pod 14.

A lead propeller 24*a* and a trailing propeller 24*b* are shown. Each propeller is connected to one of the shafts. The lead propeller 24*a* turns in a first direction and the trailing propeller turns in an opposite direction from the lead propeller simultaneously.

FIG. 3 shows a single hydraulic power unit 44 mounted in the hull fluidly connected to both the first and the second hydraulic motors 40*a* and 40*b*.

The hydraulic power unit 44 controls propeller speed independently, for both propellers, simultaneously.

In FIG. 3, the pod propulsor with propellers generates thrust for the floating vessel 10 along a thrust vector 25 using the counter rotation of the trailing propeller to recover swirling energy from the lead propeller improving propulsive efficiency of the floating vessel, and wherein the pod is positioned below the water line of the floating vessel providing propulsion without gears.

FIG. 3 shows the floating vessel 10 having a fixed strut 27 extending at least partially through a bottom passage of the floating vessel to the pod 14.

Figure 4:
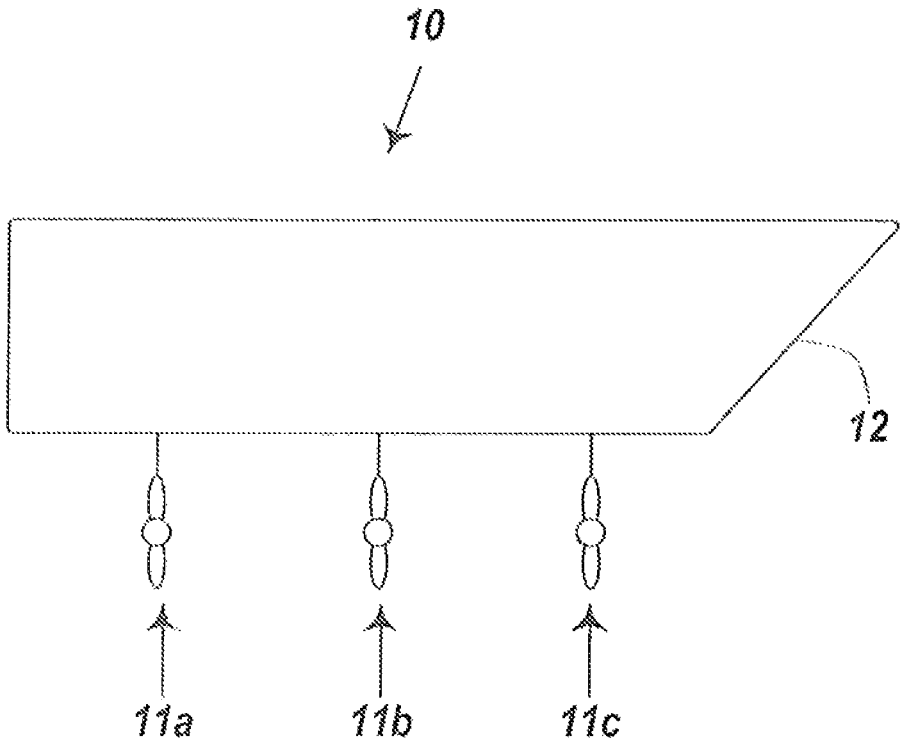
FIG. 4 depicts a configuration of the invention on a hull for dynamic positioning.

FIG. 4 depicts a configuration of the invention on a hull for dynamic positioning.

The floating vessel 10 is depicted with hull 12 having a plurality of pod propulsors 11*a*, 11*b* and 11*c* mounted to the hull enabling dynamic positioning of the floating vessel.

In embodiments, the propellers are limited diameter propellers for use in water depths from 3 feet to 20 feet enabling shallow water operation of the floating vessel with a lower propeller load.

In embodiments, each propeller has from 2 to 5 blades.

Figure 5:
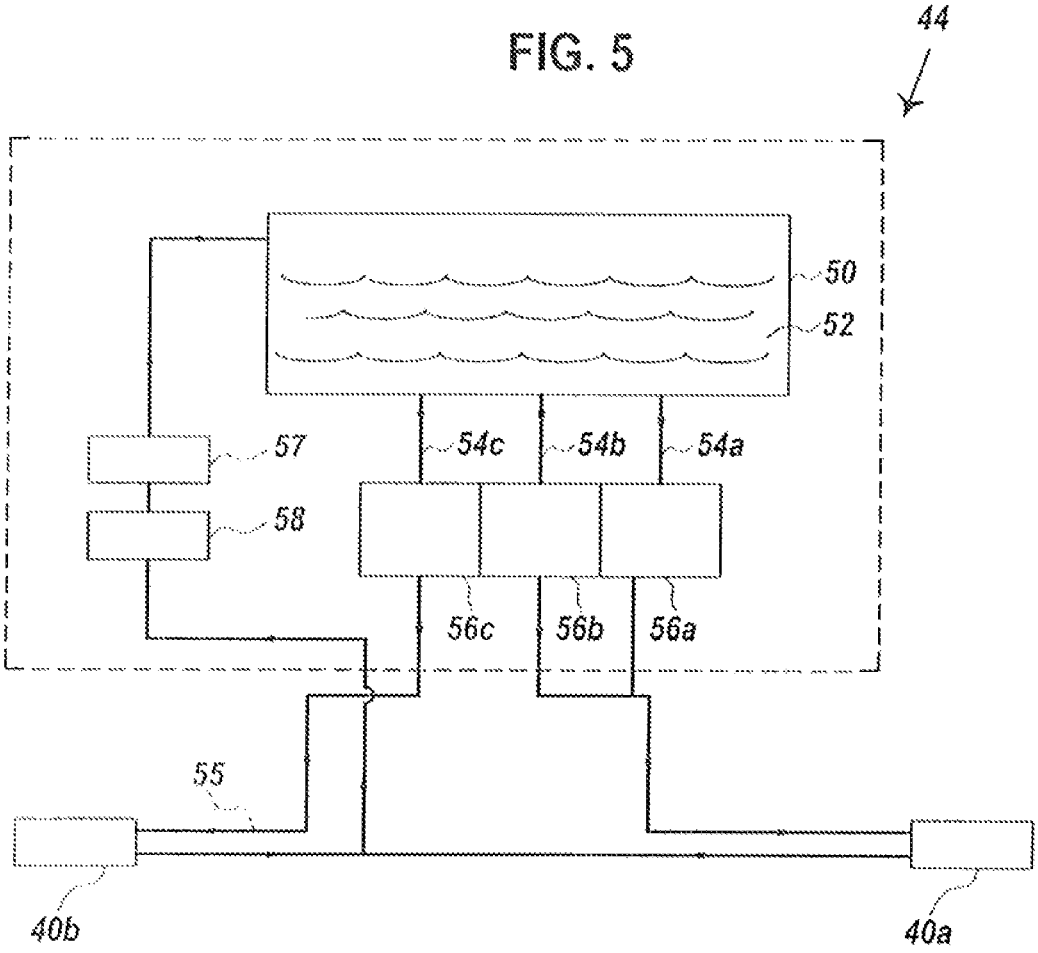
FIG. 5 depicts an embodiment of a hydraulic power unit according to the invention.

FIG. 5 depicts an embodiment of the hydraulic power unit 44 shown in FIG. 3 and according to the invention.

The floating vessel can use one or more hydraulic power units 44.

Each hydraulic power unit 44 is contained within the hull and each hydraulic power unit can separately connect to a first or a second hydraulic motor 40*a* and 40*b*.

Each hydraulic power unit 44 of the invention includes a hydraulic reservoir 50.

Each hydraulic reservoir contains hydraulic fluid 52.

Each hydraulic power unit has a plurality of conduits 54*a*, 54*b*, and 54*c* connected to the hydraulic reservoir 50.

A particulate straining filter 57 for at least partially eliminating particulate in the hydraulic fluid flowing from the hydraulic motors, is connected to the reservoir 50.

In embodiments, the particulate straining filter can strain out particles having a diameter from 1 micron to 4 centimeters.

The particulate straining filer flows the at least partially cleaned hydraulic fluid 52 back into the hydraulic reservoir 50.

Each of the conduits, 54*a*, 54*b*, and 54*c* fluidly communicate with one of the hydraulic pumps. Three hydraulic pumps are depicted as 56*a*, 56*b*, and 56*c* in this Figure.

Each hydraulic pump draws the hydraulic fluid 52 from the hydraulic reservoir 50 through the conduits and pumps hydraulic fluid to one of the hydraulic motors 40*a* and 40*b* in the pod.

FIG. 5 shows a return stream 55 from the hydraulic motors 40*a* and 40*b* to a heat exchanger 58.

The heat exchanger is configured to receive hydraulic fluid and control temperature of the hydraulic fluid during use. In embodiments, sea water is used to cool the heated hydraulic fluid from the hydraulic motors in the heat exchanger.

In embodiments, each hydraulic pump has a variable pump displacement from 0.001 cubic centimeters to 1000 cubic centimeters.

In other embodiments, a plurality of hydraulic pumps can be used, wherein the plurality of hydraulic pumps are connected in parallel providing a variable pump displacement from 0.001 cubic centimeters to 5000 cubic centimeters.

In embodiments, the hydraulic pumps can be hydrostatic transmission pumps, whereby the hydraulic systems are of closed loop design.

In embodiments, the heat exchanger is a shell and tube heat exchanger or a frame and plate heat exchanger.

The invention can be further understood by way of the following examples.

Example 1—Electric Pod Version

A floating vessel with gearless pod propulsor and counter rotating propellers having a steel mono-hull with a length overall of 200 feet, a draft 5 feet, and a beam 35 feet, and the floating vessel serves as a ferry.

The ferry can have four pod propulsors connected external to the hull.

Each pod propulsor has a metal pod providing power of 300 hp. In each pod are a pair of stators each being a 115 Kw stator. Each pod propulsor has a pair of electric rotors with permanent magnets. The permanent magnets are rare earth magnets in this example. Each electric rotor is rotating inside a stator.

Each pod has a pair of shafts. Each shaft is connected to one of the electric rotors projecting from opposite ends of the pod. Each shaft can be made from solid 3.5 inch diameter stainless steel bars that are each 2 feet long.

Each pod has a lead propeller with a diameter of 41 inches and a trailing propeller of 39 inches. The lead propeller has 4 blades and the trailing propeller has 3 blades to prevent resonance vibration.

Each propeller is connected to one of the shafts. The lead propeller turns in a first direction such as clockwise or counterclockwise and the trailing propeller turns in an opposite direction from the lead propeller simultaneously.

A first variable frequency drive controlling frequencies from 0 to 500 Hz is mounted in the hull connected to the first stator.

A second variable frequency drive is mounted in the hull and connected to the second stator. The second variable frequency drive is identical to the first variable frequency drive. The variable frequency drives control the rotating speeds of the propellers.

The variable frequency drives control propeller speed independently, applying equal torque to each of the propellers.

Each variable frequency drive is controlled whereby the output frequency is proportional to the position of a joystick controller on the bridge of the floating vessel.

Each pod propulsor with propellers can generate thrust from 0 to 8000 lbs/force for the floating vessel along a thrust vector using the counter rotation of the trailing propeller to recover swirling energy from the lead propeller improving propulsive efficiency of the ferry.

Each pod is positioned 3 feet below the water line of the ferry providing propulsion for the floating vessel without gears.

For this ferry, a steering unit with steerable strut capable of 360 degrees of motion extends at least partially through a bottom passage of the ferry to the pod. The steering unit with steerable strut is an azimuthing unit.

The ferry propellers are limited diameter propellers for use in water depths from 3 feet to 20 feet enabling shallow water operation of the floating vessel with a lower propeller load.

Example 2—Electric Pod Version

A floating vessel such as a harbor tug, with gearless pod propulsor and counter rotating propellers, has a 100 feet LOA hull made of steel.

Two pod propulsors, each 8 feet long, are connected external to the hull via a 4 foot long strut that rotates.

Each pod propulsor has an elliptical shaped steel pod acting as a hollow housing.

Each pod contains a pair of electromagnetic stators and a pair of permanent magnetic rotors mounted in the pod, wherein each rotor is connected to a stator. For this example, each stator has a diameter of 14 inches, and each rotor has a diameter of 7 inches. For this example, 12 magnets are used on each rotor.

Each pod has a pair of shafts. Each shaft is connected to one of the electric rotors partially projecting from opposite ends of the pod. Each shaft is a 3 inch diameter shaft with a length of 6 feet. Each shaft is made from solid steel rod.

A lead propeller with 4 blades and a pitch of 54 inches and a trailing propeller with 3 blades and a pitch of 44 inches are used, one on each end of the pod, with each propeller connected to one of the shafts.

The lead propeller turns in a first direction, clockwise, and the trailing propeller turns in an opposite direction counter-clockwise from the lead propeller simultaneously.

A first variable frequency drive, in this case, a Danfoss™ variable frequency drive ("VFD") is mounted in the hull and electrically connected to the first stator.

A second variable frequency drive can be identical to the first variable frequency drive and is mounted in the hull and electrically connected to the second stator.

The variable frequency drives control propeller speed independently and are connected to a controller receiving instructions from the navigation of a tugboat.

The pod propulsor with propellers generates thrust from 0 to 60 tons of water flow for the harbor tug along a thrust vector using the counter rotation of the trailing propeller to recover swirling energy from the lead propeller improving propulsive efficiency of the harbor tug, and wherein the pod is positioned below a water line of the harbor tug providing propulsion for the harbor tug without gears.

Example 3—Electric Pod Version

A floating vessel such as a firefighting vessel, with gearless pod propulsor and counter rotating propellers, has a 65 feet LOA hull made of steel.

Two pod propulsors, each 6 feet long, are connected external to the hull, each via a 3 foot long strut that rotates.

Each pod propulsor has a cylindrical shaped steel pod acting as a hollow housing.

Each pod contains a pair of electromagnetic stators and a pair of permanent magnetic rotors mounted in the pod, wherein each rotor is connected to a stator. For this example, each stator has a diameter of 12 inches, and each rotor has a diameter of 6 inches. For this example, 16 magnets are used on each rotor.

Each pod has a pair of shafts. Each shaft is connected to one of the electric rotors partially projecting from opposite ends of the pod. Each shaft is a 2.5 inch diameter shaft with a length of 4 feet. Each shaft is made from solid steel rod.

A lead propeller with 5 blades and a pitch of 48 inches and a trailing propeller with 3 blades and a pitch of 44 inches are used, one on each end of the pod, with each propeller connected to one of the shafts.

The lead propeller turns in a first direction, clockwise, and the trailing propeller turns in an opposite direction counter-clockwise from the lead propeller simultaneously.

A first variable frequency drive, in this case, a ABB™ VFD is mounted in the hull and electrically connected to the first stator.

A second variable frequency drive can be identical to the first variable frequency drive and is mounted in the hull electrically and connected to the second stator.

The variable frequency drives control propeller speed independently and are connected to a controller receiving instructions from the navigation of the firefighting vessel.

The pod propulsor with propellers generates a vessel speed from 0 knots to 16 knots for the firefighting vessel along a thrust vector using the counter rotation of the trailing propeller to recover swirling energy from the lead propeller improving propulsive efficiency of the firefighting vessel, and wherein the pod is positioned below a water line of the firefighting vessel providing propulsion for the firefighting vessel without gears.

Example 4—Hydraulic Pod Version

An offshore supply vessel that is 300 feet in length overall has a hull with two pod propulsors with counter rotating propellers. Other examples contemplate that the hull could be a catamaran or trimaran configuration.

Each pod propulsor is connected external to the hull and provides 1500 hp.

Each pod propulsor is a steel hollow pod that is 6 feet long, with a diameter of 26 inches.

Two hydraulic motors are mounted in the pod. Each hydraulic motor is a 600 Kw, fixed displacement axial piston motor.

In this example, each pod has two shafts made from high strength steel. Each shaft is 3 feet long with a 5 inch diameter.

Each shaft connects to one of the hydraulic motors and each shaft projects from opposite ends of each pod.

Each pod has a lead propeller with a diameter of 56 inches and a trailing propeller with a diameter of 53 inches.

Each propeller connects to one of the shafts and wherein the lead propeller turns in a first direction and the trailing propeller turns in an opposite direction from the lead propeller simultaneously.

The lead propeller has 5 blades and the trailing propeller has 4 blades in this example.

For this offshore supply vessel, a hydraulic power unit having a 1300 Kw capacity is mounted in the hull and connected to both the first and second hydraulic motor.

The hydraulic power unit has a hydraulic reservoir of 400 gallons.

The hydraulic reservoir contains hydraulic fluid, which can be biodegradable hydraulic fluid.

A plurality of conduits, which is a mixture of tubing and metal reinforced rubber hoses, connects between the hydraulic reservoir and a first and a second hydraulic pump.

Each hydraulic pump has a capacity of 300 gallons per minute. Each hydraulic pump draws the hydraulic fluid from the hydraulic reservoir through the conduits and pumps hydraulic fluid to one of the hydraulic motors in the pod.

The hydraulic power unit includes for this offshore supply vessel a shell and tube heat exchanger using sea water as the cooling medium. The heat exchanger is configured to receive hydraulic fluid to control temperature of the hydraulic fluid during use.

The hydraulic power unit controls each propeller speed independently whereby equal torque is applied to each of the hydraulic motors.

Each pod propulsor with propellers generates thrust for the offshore supply vessel along a thrust vector using the counter rotation of the trailing propeller to recover swirling energy from the lead propeller improving propulsive efficiency of at least 12% for the offshore supply vessel.

For the offshore supply vessel, each pod is positioned below the water line of the offshore supply vessel providing propulsion without gears.

For the offshore supply vessel, each pod propulsor has a steerable strut extending at least partially through a bottom passage of the vessel to the pod 14 wherein the pod with steerable strut is azimuthing.

The offshore supply vessel is capable of dynamic positioning.

Example 5—Hydraulic Pod Version

A crew boat that is 85 feet in length overall has a catamaran hull with two pod propulsors with counter rotating propellers, one on each pontoon.

Each pod propulsor is connected external to the pontoon and provides 500 hp.

Each pod propulsor is a steel hollow pod that is 5 feet long, with a diameter of 20 inches.

Two hydraulic motors are mounted in the pod. Each hydraulic motor is a 500 Hp motor.

In this example, each pod has two shafts made from high strength steel. Each shaft is 3 feet long with a 4 inch diameter.

Each shaft connects to one of the hydraulic motors and each shaft projects 30% the length of each shaft overall from opposite ends of each pod.

Each pod has a lead propeller with a diameter of 42 inches and a trailing propeller with a diameter of 40 inches.

Each propeller connects to one of the shafts and wherein the lead propeller turns in a first direction and the trailing propeller turns in an opposite direction from the lead propeller simultaneously.

The leading propeller has 5 blades and the trailing propeller has 4 blades in this example.

For this crew boat, a hydraulic power unit having a 400 Kw capacity is mounted in each pontoon and connected to a hydraulic motor.

Each hydraulic power unit has a hydraulic reservoir of 150 gallons.

The hydraulic reservoir contains hydraulic fluid, which can be biodegradable hydraulic fluid that passes the "shrimp test" of the EPA.

A plurality of conduits, which is a mixture of tubing and metal reinforced rubber hoses, connects between the hydraulic reservoir and a first and a second hydraulic pump.

Each hydraulic pump has a capacity of 300 gallons per minute. Each hydraulic pump draws the hydraulic fluid from the hydraulic reservoir through the conduits and pumps hydraulic fluid to one of the hydraulic motors in the pod.

The hydraulic power unit includes a frame and plate heat exchanger using sea water as the cooling medium. The heat exchanger is configured to receive hydraulic fluid to control temperature of the hydraulic fluid during use.

The hydraulic power unit controls each propeller speed independently whereby equal torque is applied to each of the hydraulic motors.

Each pod propulsor with propellers generates thrust for the crew boat along a thrust vector using the counter rotation of the trailing propeller to recover swirling energy from the lead propeller improving propulsive efficiency of at least 25% for the crew boat.

For the crew boat each pod is positioned below the water line of the offshore supply vessel providing propulsion without gears.

For the crew boat, each pod propulsor has a steerable strut in a raised section of the pontoon at the stern of the crew boat, wherein the pod with steerable strut is azimuthing.

While these embodiments have been described with emphasis on the embodiments, it should be understood that within the scope of the appended claims, the embodiments might be practiced other than as specifically described herein.

What is claimed is:

1. A floating vessel with gearless pod propulsor and counter rotating propellers, comprising:

a. a hull;

b. a pod propulsor connected external to the hull, the pod propulsor comprising:

i. a pod;

ii. a pair of stators, comprising first and second stators, mounted in the pod;

iii. a pair of electric rotors mounted in the pod, wherein each electric rotor is connected to one of the stators; and iv. a pair of shafts, each shaft connected to one of the electric rotors partially projecting from opposite ends of the pod;

c. a lead propeller and a trailing propeller, each propeller connected to one of the shafts, wherein the lead propeller turns in a first direction and the trailing propeller turns in an opposite direction from the lead propeller simultaneously; and d. a first variable frequency drive mounted in the hull and electrically connected to the first stator, a second variable frequency drive mounted in the hull and electrically connected to the second stator, the variable frequency drives controlling propeller speed independently, the pod propulsor with propellers generating thrust for the floating vessel along a thrust vector using the counter rotation of the trailing propeller to recover swirling energy from the lead propeller improving propulsive efficiency of the floating vessel, and wherein the pod is positioned below a water line of the floating vessel providing propulsion for the floating vessel without gears.

2. The floating vessel of claim 1, wherein each electric rotor and stator combination forms a permanent magnet motor.

3. The floating vessel of claim 2, wherein the permanent magnet motor uses a rare earth magnet.

4. The floating vessel of claim 1, comprising a steering unit with steerable strut extending at least partially through a bottom passage of the floating vessel to the pod, wherein the steering unit with steerable strut is azimuthing.

5. The floating vessel of claim 1, comprising at least one nozzle disposed around at least one of the propellers.

6. The floating vessel of claim 1, comprising a plurality of pod propulsors mounted to the hull enabling dynamic positioning of the floating vessel.

7. The floating vessel of claim 1, wherein the propellers are limited diameter propellers for use in water depths from 3 feet to 20 feet enabling shallow water operation of the floating vessel with a lower propeller load.

8. The floating vessel of claim 1, wherein each propeller has from 2 to 5 blades.

9. A floating vessel with gearless pod propulsor with counter rotating propellers comprising:

a. a hull;

b. a pod propulsor connected external to the hull, the pod propulsor comprising:

i. a pod;

ii. first and second hydraulic motors mounted in the pod;

iii. first and second shafts, each shaft connected to one of the hydraulic motors and each shaft projecting partially from opposite ends of the pod;

c. a lead propeller and a trailing propeller, each propeller connected to one of the shafts, wherein the lead propeller turns in a first direction and the trailing propeller turns in an opposite direction from the lead propeller simultaneously; and d. a hydraulic power unit mounted in the hull connected fluidly to both the first and second hydraulic motors, the hydraulic power unit controlling propeller speed independently, the pod propulsor with propellers generating thrust for the floating vessel along a thrust vector using the counter rotation of the trailing propeller to recover swirling energy from the lead propeller improving propulsive efficiency of the floating vessel, and wherein the pod is positioned below a water line of the floating vessel providing propulsion without gears.

10. The floating vessel of claim 9, wherein each propeller has from 2 to 5 blades.

11. The floating vessel of claim 9, comprising a steering unit with steerable strut extending at least partially through a bottom passage of the floating vessel to the pod wherein the steering unit with steerable strut is azimuthing.

12. The floating vessel of claim 9, comprising at least one nozzle disposed around at least one of the propellers.

13. The floating vessel of claim 9, comprising a plurality of pod propulsors mounted to the hull enabling dynamic positioning of the floating vessel.

14. The floating vessel of claim 9, wherein the propellers are limited diameter propellers for use in water depths from 3 feet to 20 feet enabling shallow water operation of the floating vessel with a lower propeller load.

15. The floating vessel of claim 9, wherein each hydraulic power unit comprising: a. a hydraulic reservoir, each hydraulic reservoir containing hydraulic fluid; b. a plurality of conduits connected to the hydraulic reservoir; and c. first and second hydraulic pumps, each hydraulic pump drawing the hydraulic fluid from the hydraulic reservoir through the conduits and pumping hydraulic fluid to one of the hydraulic motors in the pod.

16. The floating vessel of claim 15, wherein each hydraulic pump has a variable pump displacement from 0.001 cubic centimeters to 1000 cubic centimeters.

17. The floating vessel of claim 9, comprising: a heat exchanger in the hull to receive hydraulic fluid from the hydraulic motors to control temperature of the hydraulic fluid during use.

18. The floating vessel of claim 17, wherein the heat exchanger is a shell and tube heat exchanger or a frame and plate heat exchanger.

19. The floating vessel of claim 9, the hydraulic power unit comprising a plurality of hydraulic pumps connected in parallel, the plurality of hydraulic pumps providing a variable pump displacement from 0.001 cubic centimeters to 5000 cubic centimeters.

20. The floating vessel of claim 9, comprising a particulate straining filter mounted in the hull for at least partially removing particulate from the hydraulic fluid as the hydraulic fluid flows from the hydraulic motors.

21. The floating vessel of claim 9, comprising a fixed strut between the hull and the pod.

* * * * *